US011499365B2

(12) United States Patent
Feil

(10) Patent No.: US 11,499,365 B2
(45) Date of Patent: Nov. 15, 2022

(54) FRAME ASSEMBLY WITH REINFORCED CORNER STRUCTURE

(71) Applicant: Vision Extrusions Group Limited, Woodbridge (CA)

(72) Inventor: Don Feil, Woodbridge (CA)

(73) Assignee: Vision Extrusions Group Limited, Woodbridge (CA)

( * ) Notice: Subject to any disclaimer, the term of this patent is extended or adjusted under 35 U.S.C. 154(b) by 351 days.

(21) Appl. No.: 16/795,528

(22) Filed: Feb. 19, 2020

(65) Prior Publication Data

US 2020/0263489 A1 Aug. 20, 2020

Related U.S. Application Data

(60) Provisional application No. 62/807,615, filed on Feb. 19, 2019.

(51) Int. Cl.
*E06B 3/96* (2006.01)
*E06B 3/968* (2006.01)
*E06B 3/964* (2006.01)

(52) U.S. Cl.
CPC ..... *E06B 3/968* (2013.01); *E06B 3/9632* (2013.01); *E06B 3/9642* (2013.01); *E06B 3/9687* (2013.01)

(58) Field of Classification Search
CPC ..... E06B 3/96; E06B 3/9632; E06B 3/964; E06B 3/9641; E06B 3/9642; E06B 3/968; E06B 3/9687
See application file for complete search history.

(56) References Cited

U.S. PATENT DOCUMENTS 6,079,169 A * 6/2000 Ashworth ..... E06B 3/9632 52/217
6,881,005 B2 * 4/2005 Sosa ..... E06B 11/02 403/395

FOREIGN PATENT DOCUMENTS

| | | | | |
|---|---|---|---|---|
| CN | 105909141 A * | 8/2016 | | |
| DE | 10212229 A1 * | 10/2003 | ..... | E06B 3/9616 |
| DE | 202009004738 U1 * | 8/2010 | ..... | E06B 1/70 |
| DE | 202011050519 U1 * | 8/2012 | ..... | E06B 1/70 |
| FR | 2960900 A1 * | 12/2011 | ..... | E06B 3/9632 |
| GB | 2150182 A * | 6/1985 | ..... | E06B 3/9641 |

* cited by examiner

*Primary Examiner* — Ryan D Kwiecinski
(74) *Attorney, Agent, or Firm* — Ridout & Maybee LLP

(57) ABSTRACT

A kit for a frame assembly is disclosed. The kit comprises a first frame member, a second frame member, and a first and second counterpart of a corner connector. The first and second counterparts are co-operatively configured for connecting to obtain the corner connector. The first counterpart, the second counterpart, the first frame member, and the second frame member are co-operatively configured for assembly to define the frame assembly. The first frame member is coupled to the second frame member via the obtained corner connector. The corner connector is connected to the first frame member along a first side of the first frame member and is also connected along a second side of the first frame member, and the corner connector is connected to the second frame member along a first side of the second frame member and is also connected along a second side of the second frame member.

28 Claims, 12 Drawing Sheets

FRAME ASSEMBLY WITH REINFORCED CORNER STRUCTURE

FIELD

The present disclosure relates to a frame assembly having a reinforced corner structure.

BACKGROUND

Frames are structural systems that provide support to other components, such as a door or a window. For example, a doorframe may have two vertical components and two horizontal components that are connected together to define a rectangular frame, and may be connected to a door of a similar rectangular shape using a hinge.

Unfortunately, the corners of existing frames may be structurally weak. The vertical component may only be connected to the horizontal component using screws, and such a connection may be further weakened or damaged during transport, installation, or use of the frame. A weakened or damaged connection at the corner of the frame may reduce the strength of the frame, which may increase the risk of structural failure of the frame. Accordingly, existing frames may require additional supports, such as metal plates or reinforcement members, to strengthen the corners of the frame.

SUMMARY

In one aspect, there is provided a kit for a frame assembly, comprising: a first frame member; a second frame member; a first counterpart of a corner connector; and a second counterpart of the corner connector; wherein: the first counterpart and the second counterpart are co-operatively configured for connecting to obtain the corner connector; and the first counterpart, the second counterpart, the first frame member, and the second frame member are cooperatively configured for assembly to define a frame assembly, wherein the frame assembly includes: the first frame member; the second frame member; wherein: the first frame member is coupled to the second frame member via the obtained corner connector; the corner connector is connected to the first frame member along a first side of the first frame member and is also connected along a second side of the first frame member; and the corner connector is connected to the second frame member along a first side of the second frame member and is also connected along a second side of the second frame member.

In another aspect, there is provided a corner connector kit comprising: a first counterpart and a second counterpart connectable to obtain a corner connector; the first counterpart and the second counterpart are co-operatively configurable with a first frame member and a second frame member to define a frame assembly; wherein: the first frame member is coupled to the second frame member via the obtained corner connector; the corner connector is connected to the first frame member along a first side of the first frame member and is also connected along a second side of the first frame member; and the corner connector is connected to the second frame member along a first side of the second frame member and is also connected along a second side of the second frame member.

In another aspect, there is provided a corner connector that is co-operatively configurable with a first frame member and a second frame member to define a frame assembly, wherein: the first frame member is coupled to the second frame member via the corner connector; the corner connector is connected to the first frame member along a first side of the first frame member and is also connected along a second side of the first frame member; and the corner connector is connected to the second frame member along a first side of the second frame member and is also connected along a second side of the second frame member.

Other aspects will be apparent from the description and drawings provided herein.

BRIEF DESCRIPTION OF DRAWINGS

In the figures, which illustrate example embodiments.

DETAILED DESCRIPTION

A frame assembly 10 with a corner connector or corner key that is configured to strengthen a corner of the frame assembly is disclosed. The frame includes a vertical jamb and a horizontal sill that are connected to the corner connector, which includes an anchor bracket and an end cap. While the vertical jamb, horizontal sill, the anchor bracket, and the end cap are connected together, a frame assembly having a corner is defined. The connections that secure the vertical jamb, horizontal sill, the anchor bracket, and the end cap together have a plurality of directions, which increases the strength, stiffness, and rigidity of the corner of the frame assembly. In addition, the corner connector is connected to the vertical jamb along a first side of the vertical jamb and is also connected along a second side of the vertical jamb, and the corner connector is connected to the horizontal sill along a first side of the horizontal sill and is also connected along a second side of the horizontal sill, to increase the strength, stiffness, and rigidity of the corner of the frame assembly. When the vertical jamb, horizontal sill, the anchor bracket, and the end cap are connected together, the vertical jamb and horizontal sill obscure at least a portion of the anchor bracket and the end cap, such that at least a portion of the corner connector is obscured from view.

Figure 1:
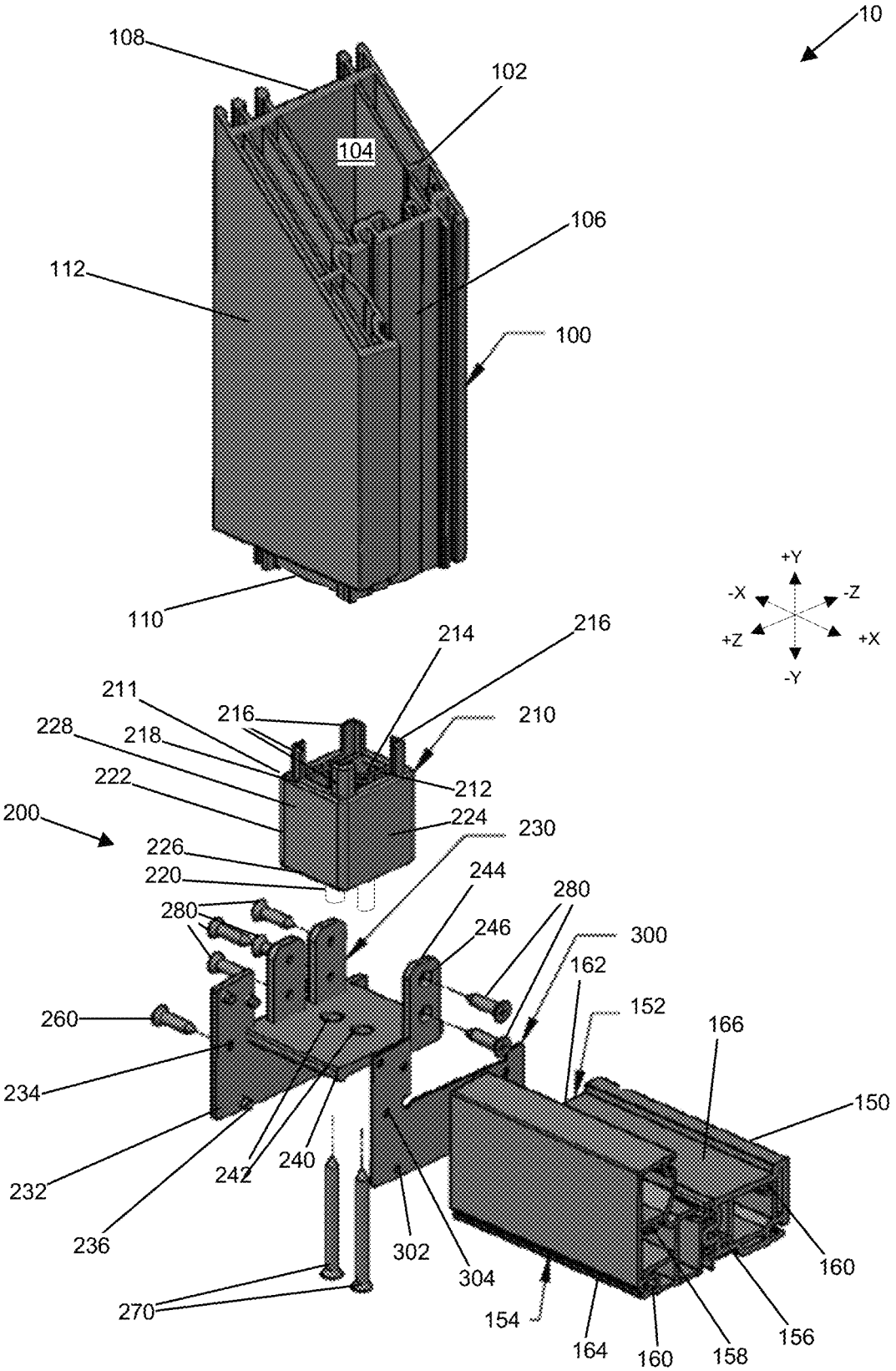
FIG. 1 is an exploded view of an embodiment of a frame assembly.

In some embodiments, for example, as depicted in FIG. 1, the frame assembly 10 includes a first component, such as a first frame member 100. As depicted in FIG. 1, the first frame member 100 has a unitary one-piece body. In some embodiments, for example, the first frame member 100 includes two or more counterparts that are connected together using appropriate fasteners, such as nuts and bolts, screws, nails, pegs, adhesives, and the like, or connected together using a snap-fit connection, a friction fit connection, an interference connection, and the like.

The first frame member 100 includes one or more ribs 102 that provide strength, stiffness, and rigidity for the first frame member 100. In some embodiments, for example, as depicted in FIG. 1, the ribs 102 define one or more chambers in the first frame member 100.

The first frame member 100 includes a channel 104. As depicted in FIG. 1, the channel 104 extends along an axis that is parallel to a longitudinal axis of the first frame member 100. As described in greater detail below, the channel 104 is configured to receive a first counterpart 210 of a corner connector 200, or both the first counterpart 210 and a reinforcement extension 250, for assembling the frame assembly 10.

When the frame assembly 10 is assembled, the first frame member 100 defines a vertical portion of the frame assembly 10, as depicted in FIG. 1. In some embodiments, for example, where the frame assembly 10 is a frame assembly for a door or a window, the first frame member 100 is a vertical jamb.

In some embodiments, for example, the first frame member 100 includes one or more sides, for example, side 106, side 108, side 110, and side 112. In some embodiments, for example, the side 106 is opposite side 108. In some embodiments, for example, side 110 is transverse, for example, perpendicular to, side 106, side 108, and side 112. In some embodiments, for example, side 112 is transverse, for example, perpendicular to, side 106, side 108, and side 110.

In some embodiments, for example, as depicted in FIG. 1, the frame assembly 10 includes a second component, such as a second frame member 150. As depicted in FIG. 1, the second frame member 150 includes two or more counterparts 152 and 154 that are connected together using appropriate fasteners, such as nuts and bolts, screws, nails, pegs, adhesives, and the like, or connected together using a snap-fit connection, a friction fit connection, an interference connection, and the like. In some embodiments, for example, the second frame member 150 has a unitary one-piece body, similar to the first frame member 100.

The second frame member 150 includes one or more ribs 156 that provide strength, stiffness, and rigidity for the second frame member 150. In some embodiments, for example, as depicted in FIG. 1, the ribs 156 define one or more chambers in the second frame member 150.

The second frame member 150 includes one or more connector receptacles 158 and guide receptacles 160. The connector receptacles 158 are configured to engage with fasteners to assemble the frame assembly 10. The guide receptacles 160 are configured to receive guides, such as the guides 236 of a second counterpart 230 of the corner connector 200, for relative positioning of the second frame member 150 and the second counterpart 230 to assemble the frame assembly 10, as described in greater detail below.

When the frame assembly 10 is assembled, the second frame member 150 defines a horizontal portion of the frame assembly 10, as depicted in FIG. 1. In some embodiments, for example, where the frame assembly 10 is a frame assembly for a door or a window, the second frame member 150 is a horizontal sill.

In some embodiments, for example, the second frame member 150 includes one or more sides, for example, side 162, side 164, and side 166. In some embodiments, for example, the side 164 is opposite side 166. In some embodiments, for example, side 162 is transverse, for example, perpendicular to, side 164 and side 166.

In some embodiments, for example, as depicted in FIG. 1 to FIG. 4, the frame assembly 10 includes a first counterpart 210 of a corner connector 200. In some embodiments, for example, the first counterpart 210 is an anchor bracket. The first counterpart 210 is configured to provide strength and rigidity to the frame assembly 10. In some embodiments, for example, the first counterpart 210 is configured to be received in the channel 104 of the first frame member 100 to provide strength and rigidity to the frame assembly 10. In this regard, in some embodiments, for example, as depicted in FIG. 1 to FIG. 4, the first counterpart 210 has a body 211 that is configured to be received in the channel 104 of the first frame member 100. In some embodiments, for example, the body 211 of the first counterpart 210 has a cross-sectional profile that is generally similar to the cross-sectional profile of the channel 104 of the first frame member 100, such that the first counterpart 210 is receivable in the channel 104. For example, as depicted in FIG. 1 to FIG. 4, the body 211 of the first counterpart 210 and the channel 104 have a generally rectangular cross-sectional profile.

In some embodiments, for example, the first counterpart 210 includes one or more ribs 212 that provide strength, stiffness, and rigidity for the first counterpart 210. As depicted in FIG. 1 to FIG. 4, one or more of the ribs 212 extend from one wall of the first counterpart 210 to another wall of the first counterpart 210.

In some embodiments, for example, the first counterpart 210 includes one or more connector bosses 214 that are configured to receive a connector 270 for assembling the frame assembly 10. As depicted in FIG. 1, the first counterpart 210 includes two connector bosses 214 that extend along an axis that is parallel to a longitudinal axis of the first counterpart 210. In some embodiments, for example, the one or more connector bosses 214 extends along the length of the body 211 of the first counterpart 210. In some embodiments, for example, the one or more connector bosses 214 are defined by the ribs 212 of the first counterpart 210.

Figure 2:
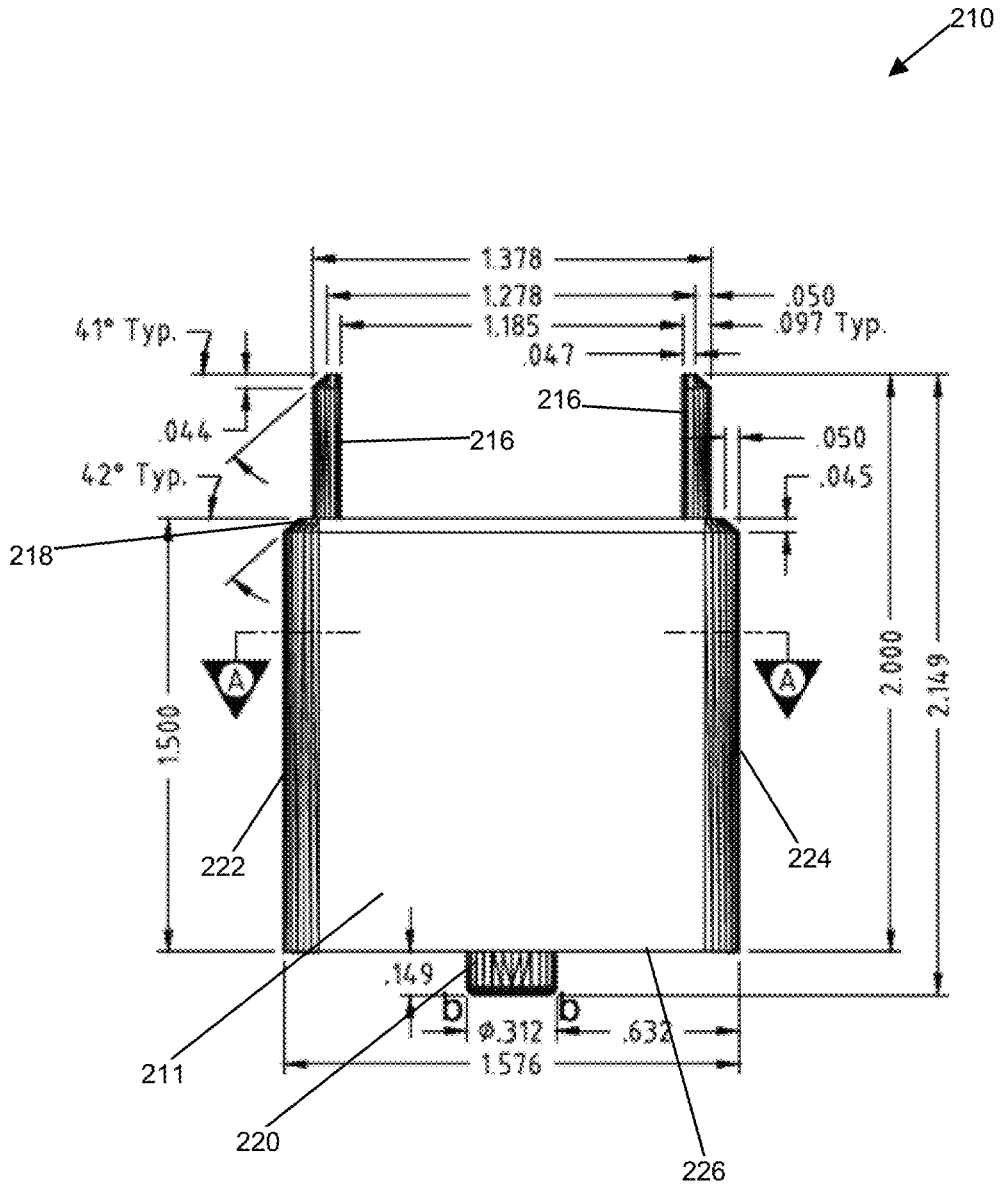
FIG. 2 is a front plan view of a first counterpart of a corner connector.

In some embodiments, for example, the connector bosses 214 extend beyond an end surface of the first counterpart 210 to define connector boss extensions 220, as depicted in FIG. 1 and FIG. 2. The connector boss extensions 220 are configured to be received in connector ports 242 of the second counterpart 230, as described in greater detail below, to position the first counterpart 210 relative to the second counterpart 230 for assembling the frame assembly 10. As depicted in FIG. 1, when the first counterpart 210 is positioned for assembling the frame assembly 10, the connector boss extensions 220 extends in a downward direction.

In some embodiments, for example, the first counterpart 210 includes one or more sides, for example, side 222, side 224, side 226, and side 228. In some embodiments, for example, the side 222 is opposite side 224. In some embodiments, for example, side 228 is transverse, for example, perpendicular to, side 222, side 224, and side 226. In some embodiments, for example, side 226 is transverse, for example, perpendicular to, side 222, side 224, and side 228.

In some embodiments, for example, as depicted in FIG. 5 to FIG. 8, the frame assembly 10 includes a reinforcement extension 250. The reinforcement extension 250 is configured to provide additional strength, stiffness, and rigidity to the frame assembly 10. In some embodiments, for example, the reinforcement extension 250 is configured to provide additional strength, stiffness, and rigidity to the frame assembly 10 by connecting with the first counterpart 210 to increase the size, such as the axial length, of the first counterpart 210. The first counterpart 210 and the reinforcement extension 250 are co-operatively configured to be connectable to define an extended first counterpart. The longitudinal axial length of the extended first counterpart is greater than the longitudinal axial length of the first counterpart 210. In some embodiments, for example, the reinforcement extension 250 is configured to be received in the channel 104 of the first frame member 100 to provide strength and rigidity to the frame assembly 10. In this regard, in some embodiments, for example, as depicted in FIG. 5 to FIG. 8, the reinforcement extension 250 has a body 252 that is configured to be received in the channel 104 of the first frame member 100. In some embodiments, for example, the body 252 of the reinforcement extension 250 has a cross-sectional profile that is generally similar to the cross-sectional profile of the channel 104 of the first frame member 100, such that the reinforcement extension 250 is receivable in the channel 104. For example, as depicted in FIG. 1, the body 252 of the reinforcement extension 250 and the channel 104 have a generally rectangular cross-sectional profile.

In some embodiments, for example, the embodiments of the frame assembly 10 that include the reinforcement extension 250, the first counterpart 210 includes one or more tongues 216 and a ridge 218.

Figure 3:
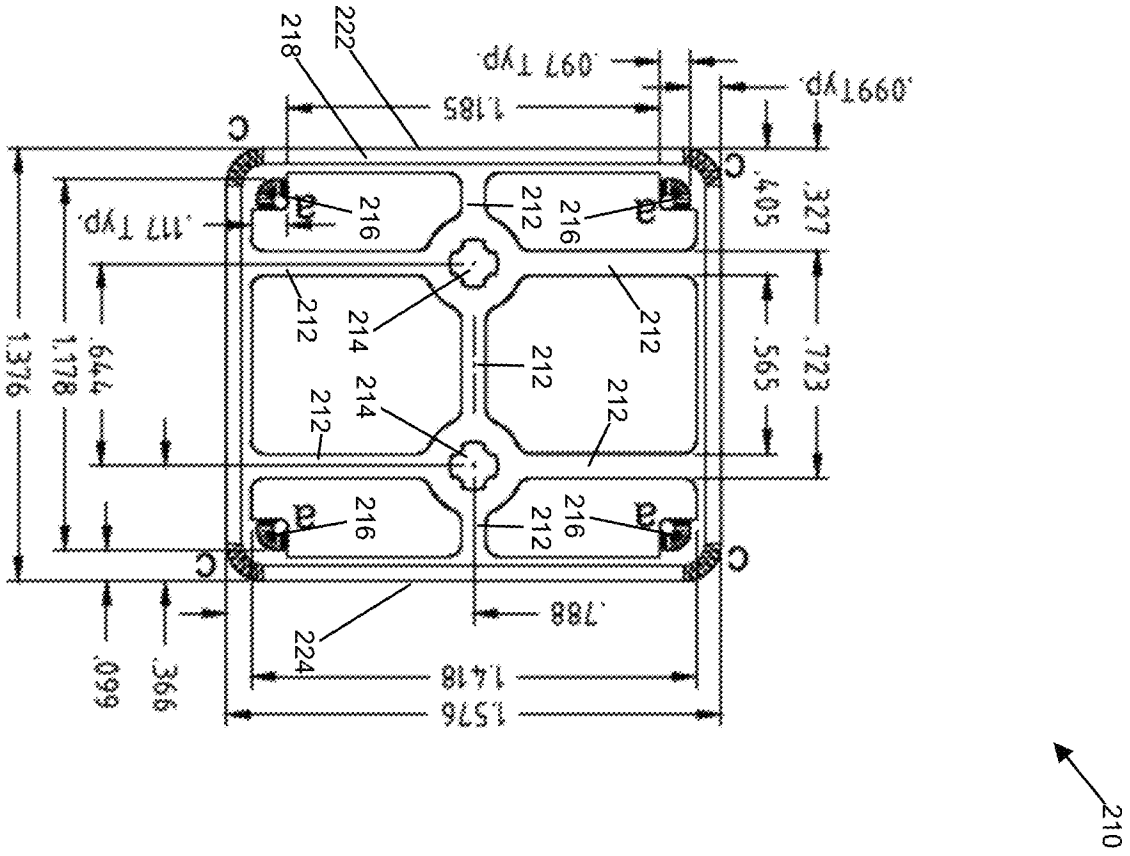
FIG. 3 is a top plan view of the first counterpart of the corner connector of FIG. 2.
Figure 4:
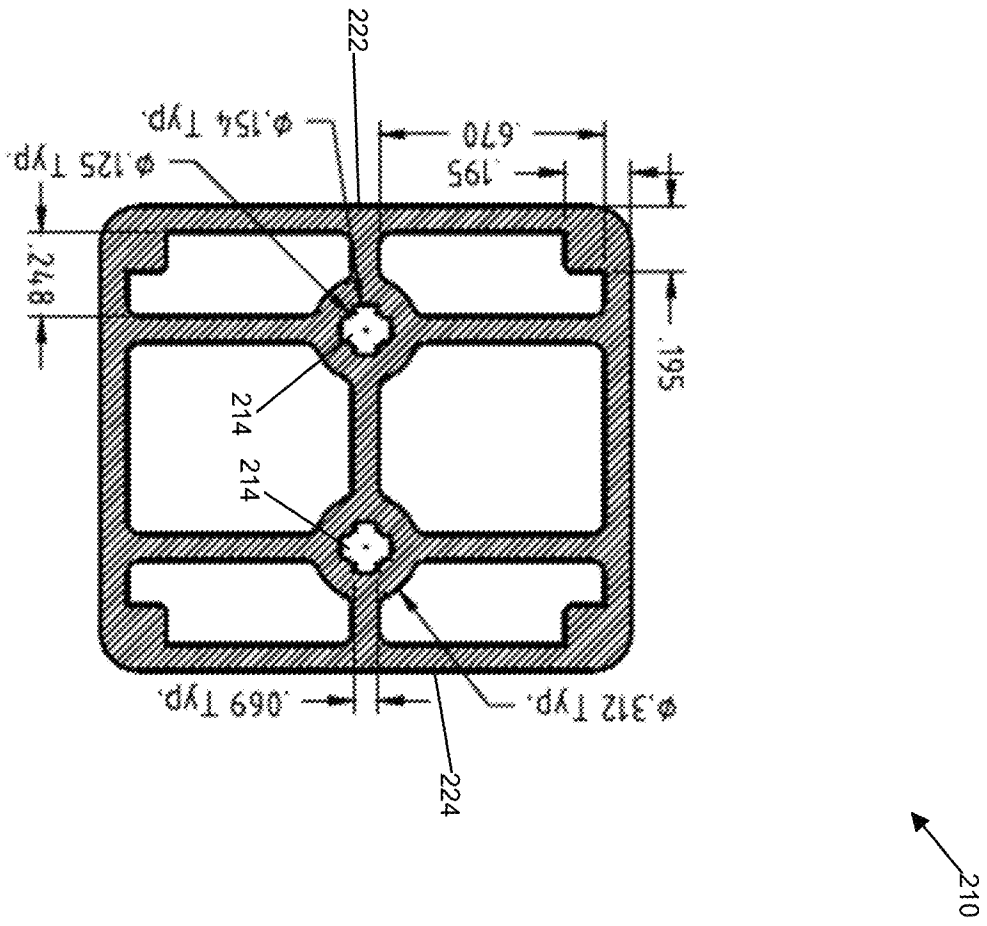
FIG. 4 is a cross-sectional view of the first counterpart of the corner connector of FIG. 2, taken at line A-A.
Figure 5:
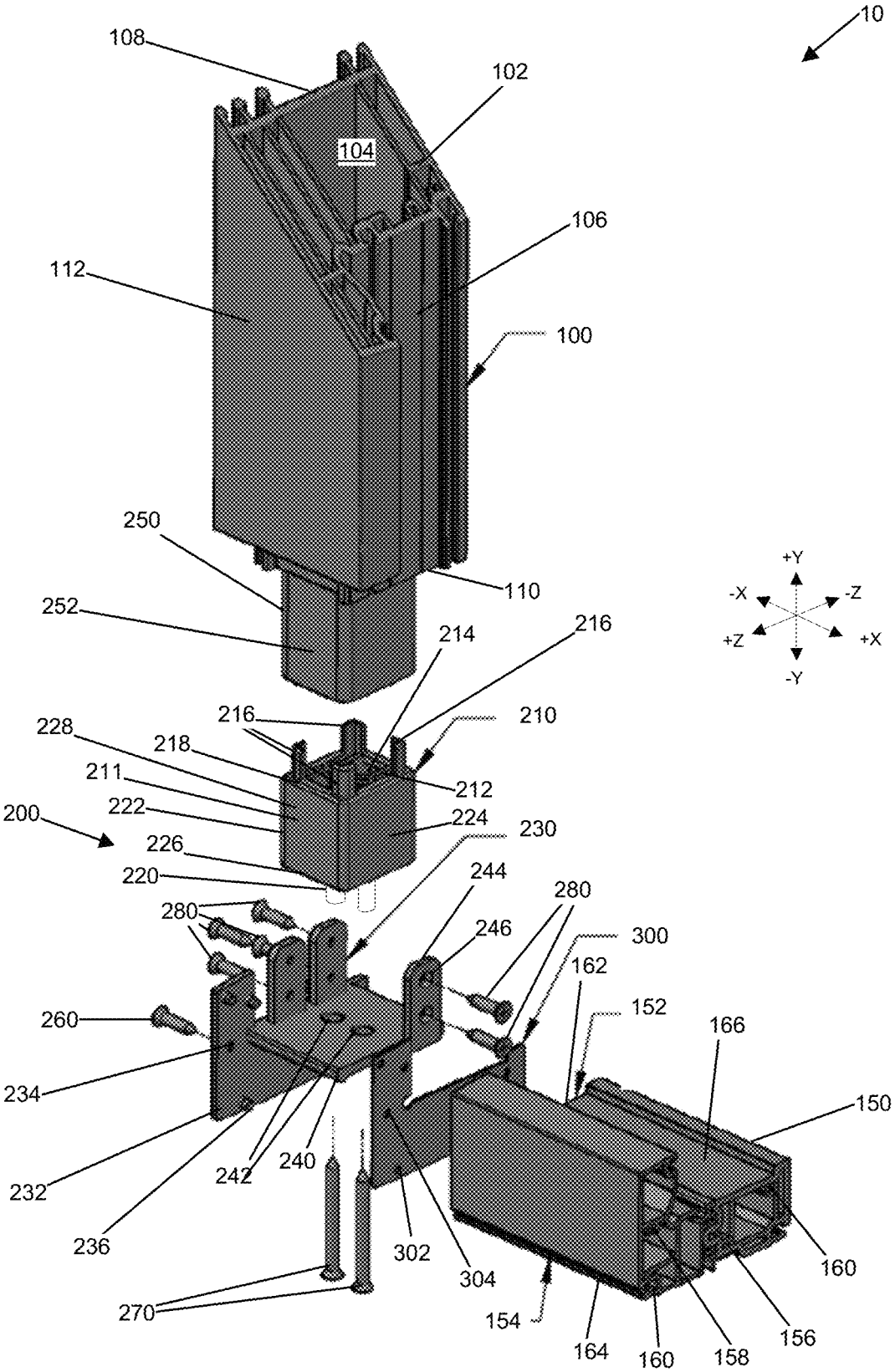
FIG. 5 is an exploded view of an alternate embodiment of the frame assembly including a reinforcement extension.
Figure 6:
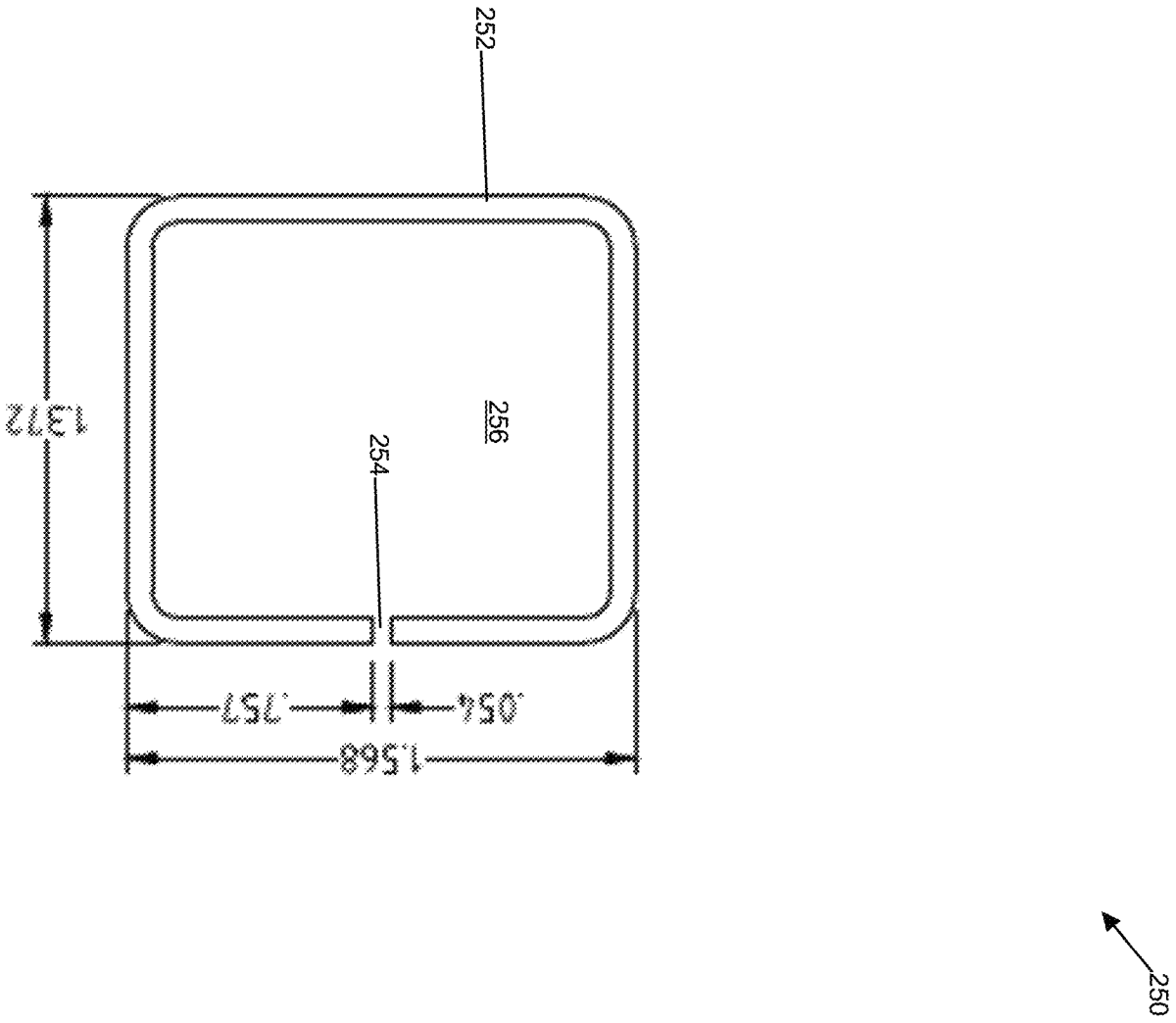
FIG. 6 is a front plan view of an embodiment of a reinforcement extension.
Figure 7:
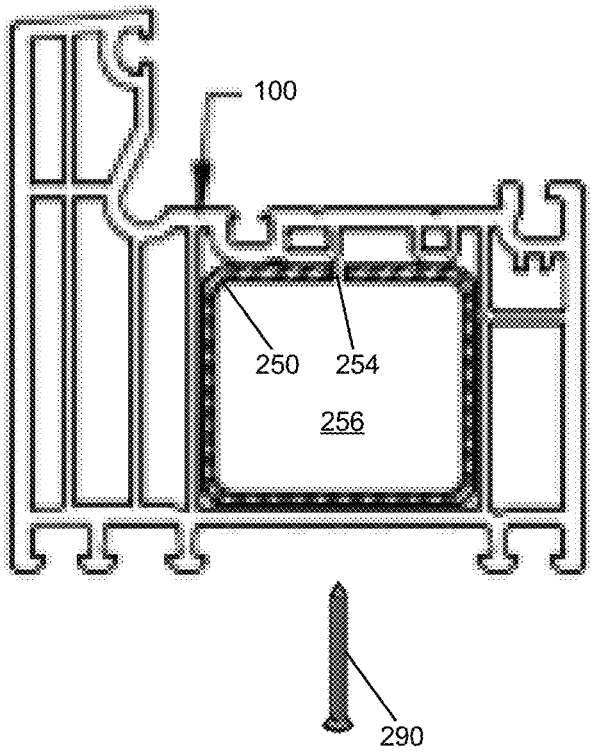
FIG. 7 is a front plan view of the reinforcement extension of FIG. 6 received in a frame member.
Figure 8:
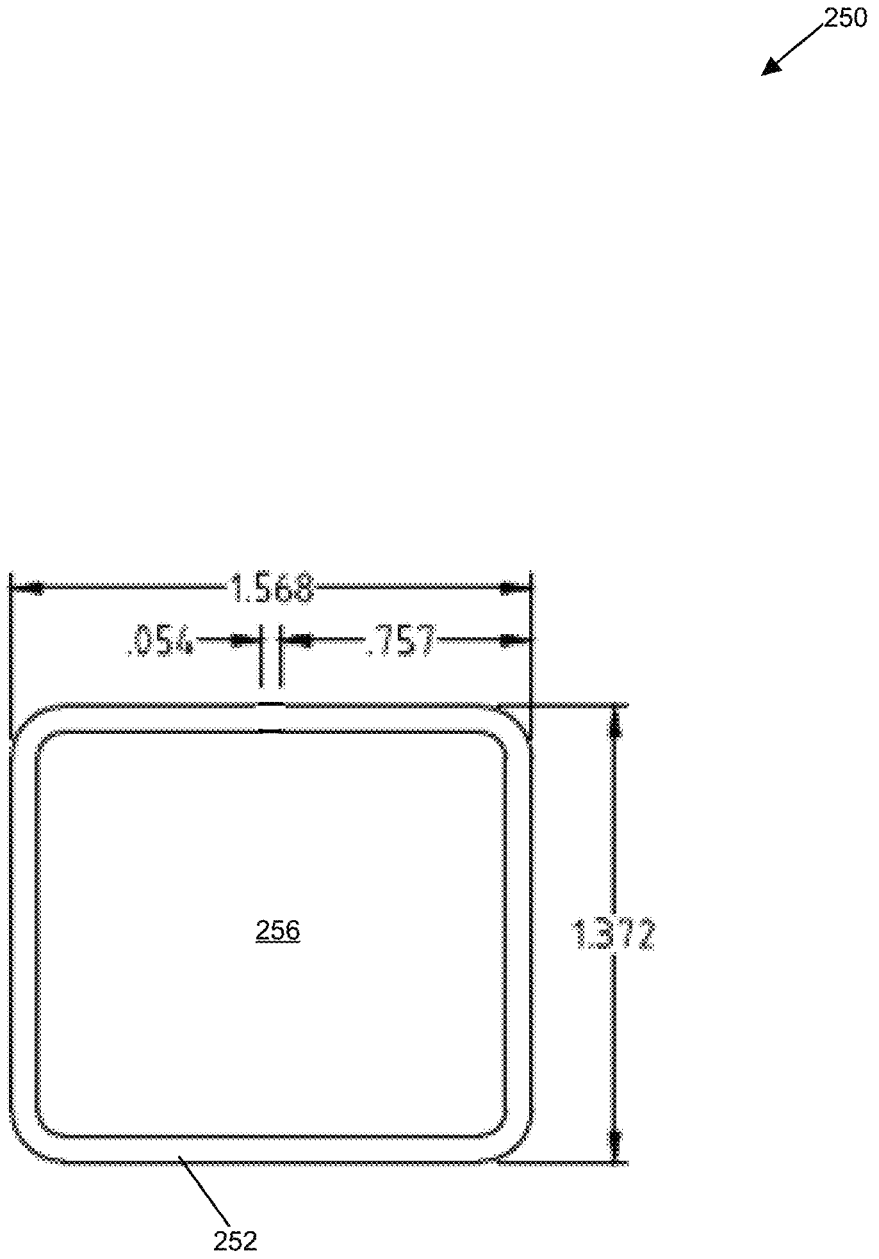
FIG. 8 is a front plan view of an alternate embodiment of the reinforcement extension.

As depicted in FIG. 1 to FIG. 3, the one or more tongues 216 of the first counterpart 210 are configured to position the reinforcement extension 250 relative to the first counterpart 210 for assembly of the frame assembly 210. As depicted in FIG. 1, in some embodiments, for example, the one or more tongues 216 extends from an end surface of the first counterpart 210. As depicted in FIG. 1, when the first counterpart 210 is positioned for assembling the frame assembly 10, the one or more tongues 216 extends in an upward direction. In some embodiments, for example, to position the reinforcement extension 250 relative to the first counterpart 210, the one or more tongues 216 are configured to be received in the reinforcement extension 250. In this regard, in some embodiments, for example, the body 252 of the reinforcement extension 250 defines one or more channels 256 to receive the one or more tongues 216. As depicted in FIG. 6 to FIG. 8, in some embodiments, for example, the body 252 defines a channel 256 to receive the one or more tongues 216. In some embodiments, for example, the one or more channels 256 that are configured to receive the one or more tongues 216 of the first counterpart 210 extend along an axis that is parallel to a longitudinal axis of the reinforcement extension 250. In some embodiments, the one or more channels 256 that are configured to receive the one or more tongues 216 of the first counterpart 210 extend along the length of the body 252 of the reinforcement extension 250. In some embodiments, for example, the reinforcement extension 250 is manufactured with steel or fibreglass. In some embodiments, for example, where the reinforcement extension 250 is manufactured with steel as a steel reinforcement, the reinforcement extension 250 has a roll formed shape, such that a gap 254 is defined in the body 252 of the reinforcement extension 250, as depicted in FIG. 6 or FIG. 7. In some embodiments, for example, the reinforcement extension 250 having the gap 254 is configured to be received in the channel 104 such that the gap 254 faces inwardly of the frame assembly 10. In some embodiments, for example, where the reinforcement extension 250 is manufactured with fibreglass, the reinforcement extension 250 is manufactured as a solid hollow tube, such that the gap 254 is absent, as depicted in FIG. 8.

In some embodiments, for example, the body 211 of the first counterpart 210 defines a ridge 218, as depicted in FIG. 2 and FIG. 3, that is configured to support the reinforcement extension 250 during assembly of the frame assembly 10. In some embodiments, for example, to connect the first counterpart 210 and the reinforcement extension 250, the tongues 216 are disposed in alignment with the one or more channels 256, and the tongues 216 are inserted into the one or more channels 256 until the reinforcement extension 250 is supported by the ridge 218. In some embodiments, for example, when the reinforcement extension 250 is supported by the ridge 218, an end surface of the reinforcement extension 250 abuts against the ridge 218, such that the reinforcement extension 250 sits on the ridge 218, while the one or more tongues 216 are received in the reinforcement extension 250.

In some embodiments, for example, as depicted in FIG. 1, the frame assembly 10 includes a second counterpart 230 of the corner connector 200. In some embodiments, for example, the second counterpart 230 is an end cap. The first counterpart 210 and the second counterpart 230 are co-operatively configured for connecting to obtain the corner connector 200, and the corner connector 200 is connectable to the first frame member 100 and the second frame member 150 to define the frame assembly 10. The second counterpart 230 is configured to position the first frame member 100, the second frame member 150, and the first counterpart 210 for assembling the frame assembly 10.

In some embodiments, for example, the first counterpart 210, the second counterpart 230, the first frame member 100, and the second frame member 150 are co-operatively configured for assembly to define a frame assembly 10. The frame assembly 10 includes the first frame member 110 and the second frame member 150. The first frame member 100 is coupled to the second frame member 150 via the corner connector 200 obtained by connecting the first counterpart 210 and the second counterpart 230. The corner connector 200 is connected to the first frame member 100 along a first side of the first frame member 100 and is also connected along a second side of the first frame member 100, for example, the side 106 and side 108. The corner connector 200 is connected to the second frame member 150 along a first side of the second frame member 150 and is also connected along a second side of the second frame member 150, for example, the side 162 and side 164.

In some embodiments, for example, the first side of the first frame member 100 is transverse, for example, perpendicular to, the second side of the first frame member 100, for example, the side 106 or side 108 and a side that is transverse, for example, perpendicular to, side 106 or side 108. In some embodiments, for example, the first side of the first frame member 100 is opposite the second side of the first frame member 100, for example, the side 106 or side 108.

In some embodiments, for example, the first side of the second frame member 150 is transverse, for example, perpendicular to, the second side of the second frame member 150, for example, the side 162 and side 164. In some embodiments, for example, the first side of the second frame member 150 is opposite the second side of the second frame member 150, for example, the side 164 and side 166.

In some embodiments, for example, one of the first counterpart 210 and the second counterpart 230 defines ports for receiving fasteners to enable fastening with the other of the first counterpart 210 and the second counterpart 230. In some embodiments, for example, one of the first counterpart 210 and the second counterpart 230 defines a first port for receiving a first fastener to enable fastening with a first side of the other one of the first counterpart 210 and the second counterpart 230, a second port for receiving a second fastener to enable fastening with a second side of the other one of the first counterpart 210 and the second counterpart 230, and a third port for receiving a third fastener to enable fastening with a third side of the other one of the first counterpart 210 and the second counterpart 230. In some embodiments, for example, the first side is transverse, for example, perpendicular to, the third side, and the second side is transverse, for example, perpendicular to, the third side. In some embodiments, for example, the second side is opposite the first side.

As depicted in FIG. 1, in some embodiments, for example, the second counterpart 230 is configured to provide a plurality of connector ports to fasten the first frame member 100, the second frame member 150, and the first counterpart 210 together for assembling the frame assembly 10. In some embodiments, for example, the second counterpart 230 is configured such that the fastening of the first frame member 100, the second frame member 150, and the first counterpart 210 has a plurality of directions, such as three directions, as depicted in FIG. 1 (positive-X, negative-X, and positive-Y). In some embodiments, for example, the first counterpart 210 and the second counterpart 230 are co-operatively configured such that a plurality of sides of the first counterpart 210, such as sides 222, 224, and 226, are fastened to the second counterpart 230.

As depicted in FIG. 1, the second counterpart 230 includes a wall 232. When the second counterpart 230 is positioned for assembling the frame assembly 10, the wall 232 extends in a vertical direction. The wall 232 is configured to position the second frame member 150 relative to the second counterpart 230 for assembling the frame assembly 10. In this regard, in some embodiments, for example, the wall 232 is configured to support or abut against the second frame member 150 to position the second frame member 150 relative to the second counterpart 230 for assembling the frame assembly 10.

In some embodiments, for example, the wall 232 defines one or more connector ports 234 to receive one or more connectors 260 to connect the second counterpart 230 and the second frame member 150.

In some embodiments, for example, the wall 232 includes one or more guides 236 that extends from the wall 232 to facilitate positioning of the second frame member 150 relative to the second counterpart 230. The guides 236 are configured to be received in corresponding guide receptacles 160 of the second frame member 150 for positioning the second frame member 150 relative to the second counterpart 230. As depicted in FIG. 1, in some embodiments, for example, the guides 236 are protrusions that extend, for example, perpendicularly, from the wall 232. As depicted in FIG. 1, in some embodiments, for example, the guides 236 extend from the wall 232 in the positive-X direction.

As depicted in FIG. 1, in some embodiments, for example, the second counterpart 230 includes a wall 240. As depicted in FIG. 1, the wall 240 extends from the wall 232. In some embodiments, for example, the wall 240 extends perpendicularly from the wall 232. When the second counterpart 230 is positioned for assembling the frame assembly 10, the wall 240 extends in a horizontal direction. The wall 240 is configured to position the first frame member 100 and the first counterpart 210 relative to the second counterpart 230 for assembling the frame assembly 10. In this regard, in some embodiments, for example, the wall 240 is configured to abut against the first frame member 100 and the first counterpart 210 to position the first frame member 100 and the first counterpart 210 relative to the second counterpart 230 for assembling the frame assembly 10.

In some embodiments, for example, the wall 240 defines one or more connector ports 242 to receive one or more connectors 270 to connect the second counterpart 230 and the first counterpart 210. In some embodiments, for example, where the first counterpart 210 has connector boss extensions 220 that extend from an end surface of the first counterpart 210, the connector ports 242 are configured to receive the connector boss extensions 220 to position the first counterpart 210 relative to the second counterpart 230 for assembling the frame assembly 10. In some embodiments, for example, the first counterpart 210 and the second counterpart 230 are connected together by inserting the connector boss extensions 220 into the connector ports 242. In such embodiments, when the connector boss extensions 220 are received in the connector ports 242, the connector boss extensions 220 and the connector ports 242 define a snap-fit connection, a friction fit connection, an interference connection, and the like.

Figure 9:
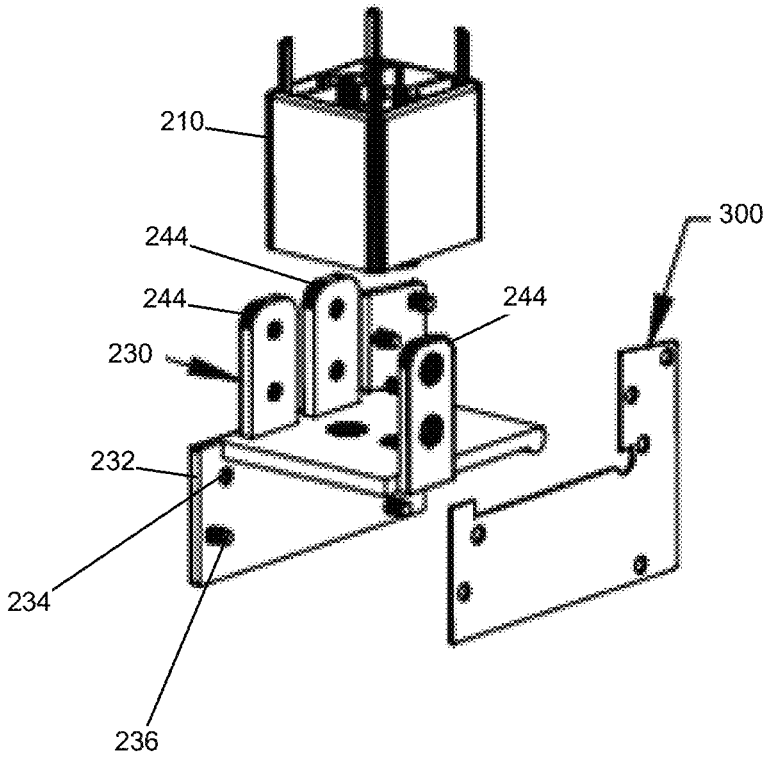
FIG. 9 is an exploded view of the first and second counterparts of the corner connector and a gasket.

As depicted in FIG. 1 and FIG. 9, in some embodiments, for example, the second counterpart 230 includes one or more arms 244. The arms 244 define one or more connector ports 246 to receive one or more connectors 280 to connect the second counterpart 230, the first frame member 100, and the first counterpart 210. As depicted in FIG. 1, in some embodiments, for example, the arms 244 extend from the wall 240, and when the second counterpart 230 is positioned for assembling the frame assembly 10, the arms 244 extends in a vertical direction, and parallel to the wall 232. As depicted in FIG. 1 and FIG. 9, the second counterpart 230 includes three arms 244, with two of the three arms 244 positioned in opposition of one of the three arms 244. In some embodiments, for example, the second counterpart 230 includes more than three arms 244 or fewer than three arms 244. In some embodiments, for example, one of the arms 244 is positioned on a side of the wall 240 that is adjacent to another side of the wall 240 that has another one of the arms 244. The arms 244 of the second counterpart 230 are positioned such that when the first counterpart 210 and the first frame member 100 are positioned relative to the second counterpart 230 for assembling the frame assembly 10, the ports 246, which are defined by the arms 244, are positioned relative to the first counterpart 210 and the first frame member 100 such that the connectors 280 are receivable through the ports 246 to connect the second counterpart 230, the first frame member 100, and the first counterpart 210.

In some embodiments, for example, the first frame member 100, the second frame member 150, the first counterpart 210, the second counterpart 230, or the reinforcement extension 250 are manufactured using polymers, such as resins, thermoplastics, thermosets, and elastomers. Example materials to manufacture the first frame member 100, the second frame member 150, the first counterpart 210, the second counterpart 230, or the reinforcement extension 250 include epoxy, phenolic, nylon, polyethylene, polystyrene, and polyvinyl chloride. In some embodiments, for example, the first frame member 100, the second frame member 150, the first counterpart 210, the second counterpart 230, or the reinforcement extension 250 are manufactured by moulding, such as injection moulding.

In some embodiments, for example, the first frame member 100, the second frame member 150, the first counterpart 210, the second counterpart 230, or the reinforcement extension 250 are manufactured using metal, such as steel or aluminum. In some embodiments, for example, the first frame member 100, the second frame member 150, the first counterpart 210, the second counterpart 230, or the reinforcement extension 250 are cast, forged, 3D-printed, or machined from the appropriate metal.

In some embodiments, for example, where the first frame member 100, the second frame member 150, the first counterpart 210, the second counterpart 230, or the reinforcement extension 250 include two or more counterparts, In some embodiments, for example, the second frame member 150, as depicted in FIG. 1, includes the first counterpart 152 and the second counterpart 154. In some embodiments, for example, one of the counterparts is manufactured with a first material, such as polyvinyl chloride, and another one of the counterparts is manufactured with a second material that is different from the first material, such as aluminum.

To assemble the frame assembly 10, the first frame member 100, the second frame member 150, the first counterpart 210, and the second counterpart 230 are connected or fastened together using connectors 260, 270, and 280. As depicted in FIG. 1, the connectors 260, 270, and 280 are screws. In some embodiments, for example, the connectors 26, 270, and 280 are fasteners, such as nuts and bolts, screws, nails, pegs, adhesives, and the like.

To assemble the frame assembly 10, the second counterpart 230 and the second frame member 150 are connected together. The second frame member 150 is positioned relative to the second counterpart 230 such that an end surface disposed along a side 162 of the second frame member 150 abuts the wall 232 of the second counterpart 230. In some embodiments, for example, the guide receptacles 160 of the second frame member 150 and the guides 236 of the second counterpart 230 are aligned. Then, in some embodiments, for example, the guides 236 of the second counterpart 230 are inserted into the corresponding guide receptacles 160 of the second frame member 150 to facilitate relative positioning of the second frame member 150 and the second counterpart 230. When the guides 236 of the second counterpart 230 are inserted into the corresponding guide receptacles 160 of the second frame member 150, the second counterpart 230 and the second frame member 150 are relatively positioned such that the second counterpart 230 and the second frame member 150 are connectable using the connectors 260.

To connect the second counterpart 230 and the second frame member 150 together, the connectors 260 are received in the connector ports 234 of the second counterpart 230 and the connector receptacles 158 of the second frame member 150. In some embodiments, for example, where the second frame member 150 includes the first counterpart 152 and the second counterpart 154, at least one connector 260 connects the second counterpart 230 and the first counterpart 152, and at least one connector 260 connects the second counterpart 230 and the second counterpart 154.

When the second counterpart 230 is connected to the second frame member 150, in some embodiments, for example, the wall 240 is positioned above the second frame member 150, with the wall 240 covering at least a portion of the second frame member 150. In some embodiments, for example, the wall 240 is disposed opposite a surface disposed on a side 166 of the second frame member 150.

In some embodiments, for example, when the guides 236 of the second counterpart 230 are inserted into the corresponding guide receptacles 160 of the second frame member 150, the second counterpart 230 and the second frame member 150 are relatively positioned such that the second counterpart 230 and the second frame member 150 are connectable using the connectors 270 that are insertable through the connector ports 242, as described in greater detail below.

In some embodiments, for example, as depicted in FIG. 1, a gasket 300 is positioned between the second counterpart 230 and the second frame member 150 to seal the abutment between the wall 232 of the second counterpart 230 and the second frame member 150. As depicted in FIG. 1, the gasket 300 has one or more guide ports 302 and one or more connector ports 304, which are configured to receive the guides 236 and the connectors 260 and for the guides 236 and the connectors 260 to extend therethrough, respectively, such that the second frame member 150 can be positioned relative to the second counterpart 230 and the second frame member 150 can be connected to the second counterpart 230.

Figure 10:
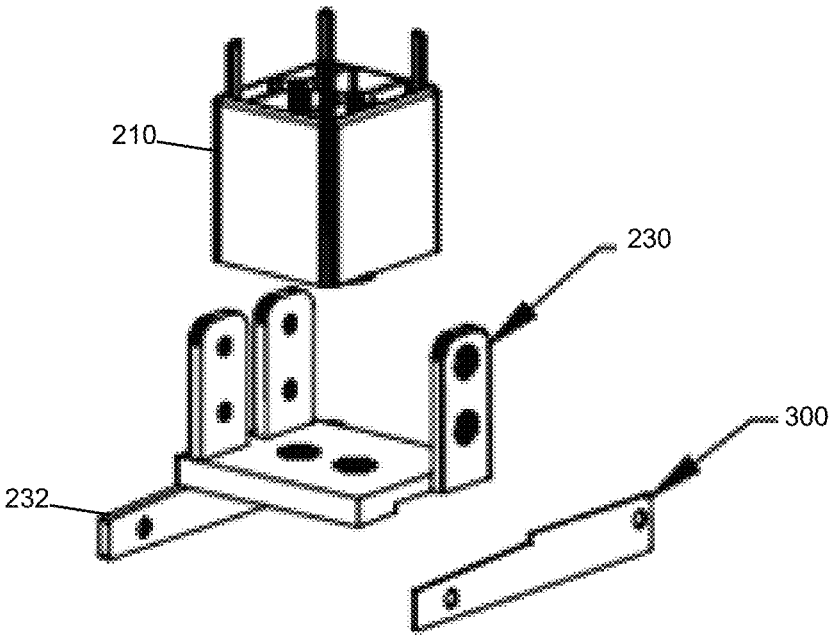
FIG. 10 is an exploded view of an alternate embodiment of first and counterparts of the corner connector and gasket.

As depicted in FIG. 9 and FIG. 10, in some embodiments, for example, the shape of the gasket 300 corresponds, or substantially corresponds, to the shape of the wall 232. FIG. 9 depicts an embodiment of the second counterpart 230, and FIG. 10 depicts an alternate embodiment of the second counterpart 230, which is smaller and has fewer ports 234 and guides 236. As depicted, the gasket 300 has guide ports 302 and connector ports 304 based on the ports 234 and guides 236 of the wall 232, and is shaped substantially similarly to the wall 232.

With the second counterpart 230 and the second frame member 150 connected, to assemble the frame assembly 10, the second counterpart 230 and the first counterpart 210 are connected together. In some embodiments, for example, the connector bosses 214 of the first counterpart 210 and the connector ports 242 of the second counterpart 230 are aligned. The first counterpart 210 is positioned relative to the second counterpart 230 such that: (1) an end surface disposed along a side 226 of the first counterpart 210 abuts the wall 240 of the second counterpart 230, and (2) the body 211, such as a side 222 and a side 224, of the first counterpart 210 is positioned relative to the ports 246 defined on the arms 244 of the second counterpart 230 such that the fasteners 280 received through the ports 246 will connect the first counterpart 210 and the second counterpart 230.

In some embodiments, where the first counterpart 210 has connector boss extensions 220, the first counterpart 210 is positioned relative to the second counterpart 230 for assembling the frame assembly 10 by aligning the connector boss extensions 220 and the connector ports 242, and inserting the connector boss extensions 220 into the connector ports 242 defined on the wall 240 of the second counterpart 230 such that: (1) an end surface disposed along a side 226 of the first counterpart 210 abuts the wall 240 of the second counterpart 230, and (2) the body 211 of the first counterpart 210 is positioned relative to the ports 246 defined on the arms 244 of the second counterpart 230 such that the fasteners 280 received through the ports 246 will connect the first counterpart 210 and the second counterpart 230.

In some embodiments, for example, the first counterpart 210 is positioned relative to the second counterpart 230 such that the side 222 and the side 224 are disposed opposite the arms 244. In some embodiments, for example, one or more arms 244 are disposed opposite the side 222, one or more arms 244 are disposed opposite the side 224, and the wall 240 is disposed opposite the side 226. In some embodiments, for example, the side 222 is opposite the side 224. In some embodiments, for example, the side 222 is adjacent the side 224.

To connect the second counterpart 230 and the first counterpart 210 together, the connectors 270 are received through the connector ports 242 of the second counterpart 230 to engage with the connector bosses 214 of the first counterpart 210. In some embodiments, for example, where the second frame member 150 is already positioned relative to the second counterpart 230 for connection with the second counterpart 230, such as when the guides 236 of the second counterpart 230 are received in the guide receptacles 160 of the second frame member 150, or where the second frame member 150 is already connected to the second counterpart 230, when the connectors 270 are received through the connector ports 242 of the second counterpart 230 to connect the second counterpart 230 and the first counterpart 210, the connectors 270 also extend through the second frame member 150, for example, through a side 160 of the second frame member 150, to connect the second frame member 150, the second counterpart 230, and the first counterpart 210 together.

Figure 11:
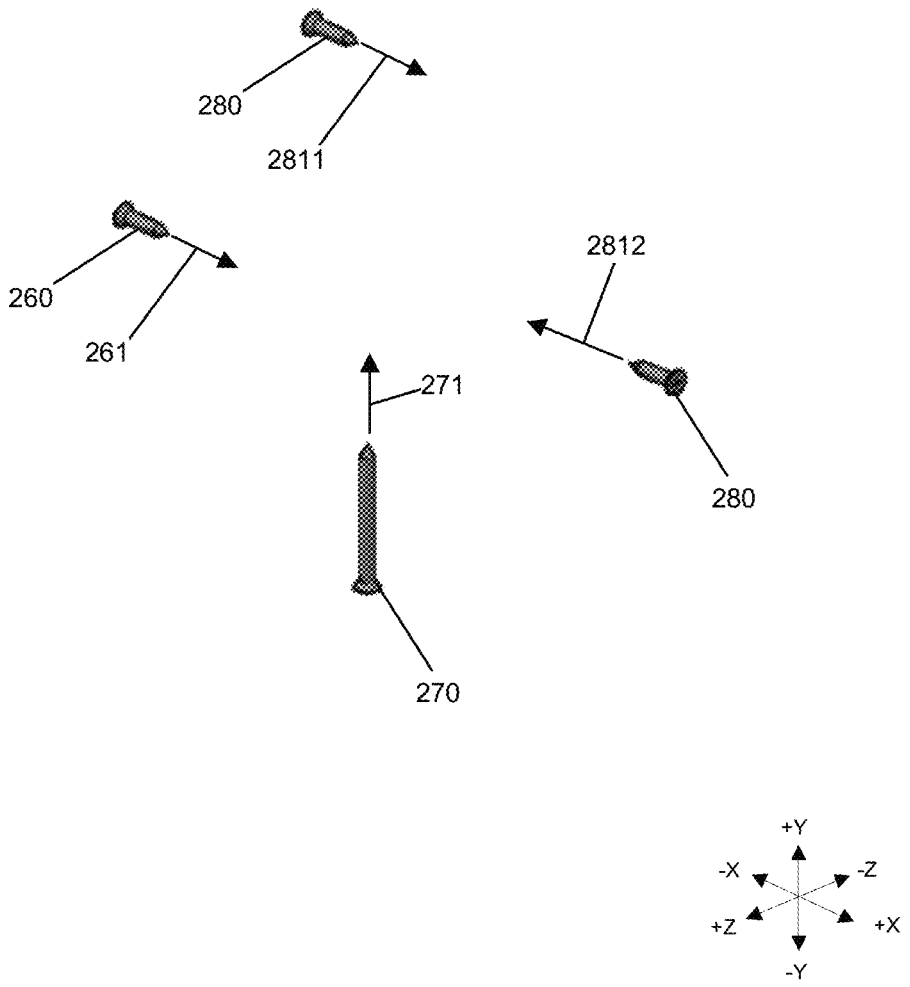
FIG. 11 is a perspective view of fasteners having a longitudinal axis.

In some embodiments, for example, the fasteners 260 and 270 connect the second frame member 150 to the second counterpart 230 of the corner connector 200 along more than one side of the second frame member 150, for example, two sides, such as the side 162 and side 164, the side 164 and side 166, or the side 162 and side 166, or three sides, such as the side 162, the side 164, and the side 166. In some embodiments, for example, to connect the second frame member 150 to the second counterpart 230 of the corner connector 200, the fasteners 260 and 270 extend through more than one side of the second frame member 150, for example, two sides, such as the side 162 and side 164, the side 164 and side 166, or the side 162 and side 166, or three sides, such as the side 162, the side 164, and the side 166. In some embodiments, for example, as depicted in FIG. 11, a fastener 260 defines a longitudinal axis 261, and a fastener 270 defines a longitudinal axis 271. In some embodiments, for example, the longitudinal axis 261 of the fastener 260 and the longitudinal axis 271 of the fastener 270 are disposed in a parallel relationship, for example, while the fastener 260 extends through a first side of the second frame member 150 and the fastener 270 extends through a second side of the second frame member 150 that is opposite and parallel to the first side. In some embodiments, for example, the longitudinal axis 261 of the fastener 260 and the longitudinal axis 271 of the fastener 270 are disposed such that an angle is defined between the longitudinal axis 261 of the fastener 260 and the longitudinal axis 271 of the fastener 270. In some embodiments, for example, the longitudinal axis 261 of the fastener 260 and the longitudinal axis 271 of the fastener 270 are disposed in a perpendicular relationship, for example, while the fastener 260 extends through a first side of the second frame member 150 and the fastener 270 extends through a second side of the second frame member 150 that is transverse, for example, perpendicular to, the first side.

In some embodiments, for example, where the frame assembly 10 includes the reinforcement extension 250, the reinforcement extension 250 is connected to the first counterpart 210 such that the reinforcement extension 250 is supported by the ridge 218 of the first counterpart 210. In some embodiments, for example, the reinforcement extension 250 is connected to the first counterpart 210 by inserting the tongues 216 into the reinforcement extension 250, such that an extended first counterpart 210 is defined. When the tongues 216 are inserted into the reinforcement extension 250, the tongues 216 and the reinforcement extension 250 define a snap-fit connection, a friction fit connection, an interference connection, and the like, and resists removal of the reinforcement extension 250 from the first counterpart 210.

In some embodiments, for example, the connectors 270 that are configured to connect the second frame member 150, the second counterpart 230, and the first counterpart 210 together are also configured to connect the second frame member 150, the second counterpart 230, the first counterpart 210, and the reinforcement extension 250 together. In such embodiments, for example, the reinforcement extension 250 includes connector bosses similar to those of the connector bosses 214 of the first counterpart 210, and the connectors 270 are configured to be engaged with the connector bosses of the reinforcement extension 250 to connect the second frame member 150, the second counterpart 230, the first counterpart 210, and the reinforcement extension 250 together.

With the second frame member 150, the second counterpart 230, and the first counterpart 210 (which may be connected to the reinforcement extension 250) connected together, the first frame member 100 and the second counterpart 230 are connected together. In some embodiments, for example, the channel 104 of the first frame member 100 and the first counterpart 210 are aligned. Then, the first frame member 100 is positioned relative to the second counterpart 230 such that: (1) an end surface disposed along a side 110 of the first frame member 100 abuts the wall 240 of the second counterpart 230, and (2) the first frame member 100 is positioned relative to the ports 246 defined on the arms 244 of the second counterpart 230 such that the fasteners 280 received through the ports 246 will connect the first frame member 100 and the second counterpart 230. In this regard, with the first counterpart 210 and the reinforcement extension 250 connected to the second counterpart 230, the first frame member 100 is positioned to receive the first counterpart 210 (and the reinforcement extension 250 if the reinforcement extension 250 is connected to the first counterpart 210) in the channel 104, and the first counterpart 210 and the reinforcement extension 250 are inserted through the channel 104 of the first frame member 100 until the end surface disposed along the side 110 of the first frame member 100 abuts against the wall 240 of the second counterpart 230. The first counterpart 210 is configured such that when the first counterpart 210 is received in the channel 104 of the first frame member 100, the first counterpart 210 and resists or limits radial displacement of the first frame member 100 relative to the longitudinal axis of the first frame member 100, such that the first frame member 100 is positioned relative to the ports 246 defined by the arms 244 of the second counterpart 230 to fasten the first frame member 100 to the second counterpart 230. In some embodiments, for example, the first counterpart 210 and the reinforcement extension 250 are configured such that when the first counterpart 210 and the reinforcement extension 250 are connected to define the extended first counterpart and received in the channel 104 of the first frame member 100, the first counterpart 210 and the reinforcement extension 250 further resist or limit radial displacement of the first frame member 100 relative to the longitudinal axis of the first frame member 100, due to the increase in length of the extended first counterpart relative to the first counterpart 210.

In some embodiments, for example, with the first counterpart 210, or both the first counterpart 210 and the reinforcement extension 250, received in the channel 104, the first frame member 100 is positioned relative to the second counterpart 230 such that the side 106 and the side 108 are disposed opposite the arms 244. In some embodiments, for example, one or more arms 244 are disposed opposite the side 106, one or more arms 244 are disposed opposite the side 108, and the wall 240 is disposed opposite the side 110. In some embodiments, for example, the side 106 is opposite the side 108. In some embodiments, for example, the side 106 is adjacent the side 108.

To connect the second counterpart 230 and the first frame member 100 together, with the first counterpart 210 connected to the second counterpart 230 and received in the channel 104, the connectors 280 are received through the connector ports 246 of the arms 244 of the second counterpart 230 and into the first frame member 100 and the first counterpart 210 to connect the first frame member 100, the first counterpart 210, and the second counterpart 230 together.

In some embodiments, for example, the fasteners 280 connect the first frame member 100 to the second counterpart 230 of the corner connector 200 along more than one side of the first frame member 100, for example, two sides, such as the side 106 and side 108. In some embodiments, for example, to connect the first frame member 100 to the second counterpart 230 of the corner connector 200, the fasteners 280 extend through more than one side of the first frame member 100, for example, two sides, such as the side 106 and side 108. In some embodiments, for example, as depicted in FIG. 11, a first fastener 280 defines a longitudinal axis 2811, and a second fastener 280 defines a longitudinal axis 2812. In some embodiments, for example, the longitudinal axis 2811 of the first fastener 280 and the longitudinal axis 2812 of the second fastener 280 are disposed in a parallel relationship, for example, while the first fastener 280 extends through a first side of the first frame member 100 and the second fastener 280 extends through a second side of the first frame member 100 that is opposite and parallel to the first side. In some embodiments, for example, the longitudinal axis 2811 of the first fastener 280 and the longitudinal axis 2812 of the second fastener 280 are disposed such that an angle is defined between the longitudinal axis 2811 of the first fastener 280 and the longitudinal axis 2812 of the second fastener 280. In some embodiments, for example, the longitudinal axis 2811 of the first fastener 280 and the longitudinal axis 2812 of the second fastener 280 are disposed in a perpendicular relationship, for example, while the first fastener 280 extends through a first side of the first frame member 100 and the second fastener 280 extends through a second side of the first frame member 100 that is transverse, for example, perpendicular to, the first side.

In some embodiments, for example, the fasteners 270 and 280 connect the first counterpart 210 to the second counterpart 230 of the corner connector 200 along more than one side of the first counterpart 210, for example, three sides, such as the side 222, side 224, and side 226. In some embodiments, for example, to connect the first counterpart 210 to the second counterpart 230 of the corner connector 200, the fasteners 270 and 280 extend through more than one side of the first counterpart 210, for example, three sides, such as the side 222, side 224, and side 226. In some embodiments, for example, as depicted in FIG. 11, a fastener 270 defines a longitudinal axis 271, a first fastener 280 defines a longitudinal axis 2811, and a second fastener 280 defines a longitudinal axis 2812. In some embodiments, for example, the longitudinal axis of one of the fasteners and the longitudinal axis of another one of the fasteners are disposed in a parallel relationship, for example, while the first fastener 280 extends through a first side of the first counterpart 210 and the second fastener 280 extends through a second side of the first counterpart 210 that is opposite and parallel to the first side, such as sides 222 and 224. In some embodiments, for example, the longitudinal axis of one of the fasteners and the longitudinal axis of another one of the fastener are disposed such that an angle is defined between the longitudinal axis of one of the fasteners and the longitudinal axis of the another one of the fastener. In some embodiments, for example, the longitudinal axis of one of the fasteners and the longitudinal axis of another one of the fastener are disposed in a perpendicular relationship. In some embodiments, for example, the longitudinal axis 2811 of the first fastener 280 and the longitudinal axis 2812 of the second fastener 280 are disposed in a perpendicular relationship, for example, while the first fastener 280 extends through a first side of the first counterpart 210 and the second fastener 280 extends through a second side of the first counterpart 210 that is transverse, for example, perpendicular to, the first side, such as side 222 and a side that is transverse, for example, perpendicular to, the side 222. In some embodiments, for example, the longitudinal axis 2811 of the first fastener 280 and the longitudinal axis 271 of the fastener 270 are disposed in a perpendicular relationship, for example, while the first fastener 280 extends through a first side of the first counterpart 210 and the fastener 270 extends through a second side of the first counterpart 210 that is transverse, for example, perpendicular to, the first side, such as side 222 and side 226. In some embodiments, for example, the longitudinal axis 2812 of the second fastener 280 and the longitudinal axis 271 of the fastener 270 are disposed in a perpendicular relationship, for example, while the second fastener 280 extends through a first side of the first counterpart 210 and the fastener 270 extends through a second side of the first counterpart 210 that is transverse, for example, perpendicular to, the first side, such as side 224 and side 226.

In some embodiments, for example, where the reinforcement extension 250 is received in the channel 104 of the first frame member 100, the first frame member 100 and the reinforcement extension 250 are connected using one or more additional fasteners 290, as depicted in FIG. 7. In some embodiments, an additional fastener 290 is inserted through the side 108 of the first frame member 100, and into the reinforcement extension 250 to connect the first frame member 100 and the reinforcement extension 250. In some embodiments, for example, more fasteners are used based on the longitudinal axial length of the reinforcement extension 250. In some embodiments, for example, an additional fastener is used to connect the first frame member 100 and the reinforcement extension 250 for every 12 inches of longitudinal axial length of the reinforcement extension 250.

Figure 12:
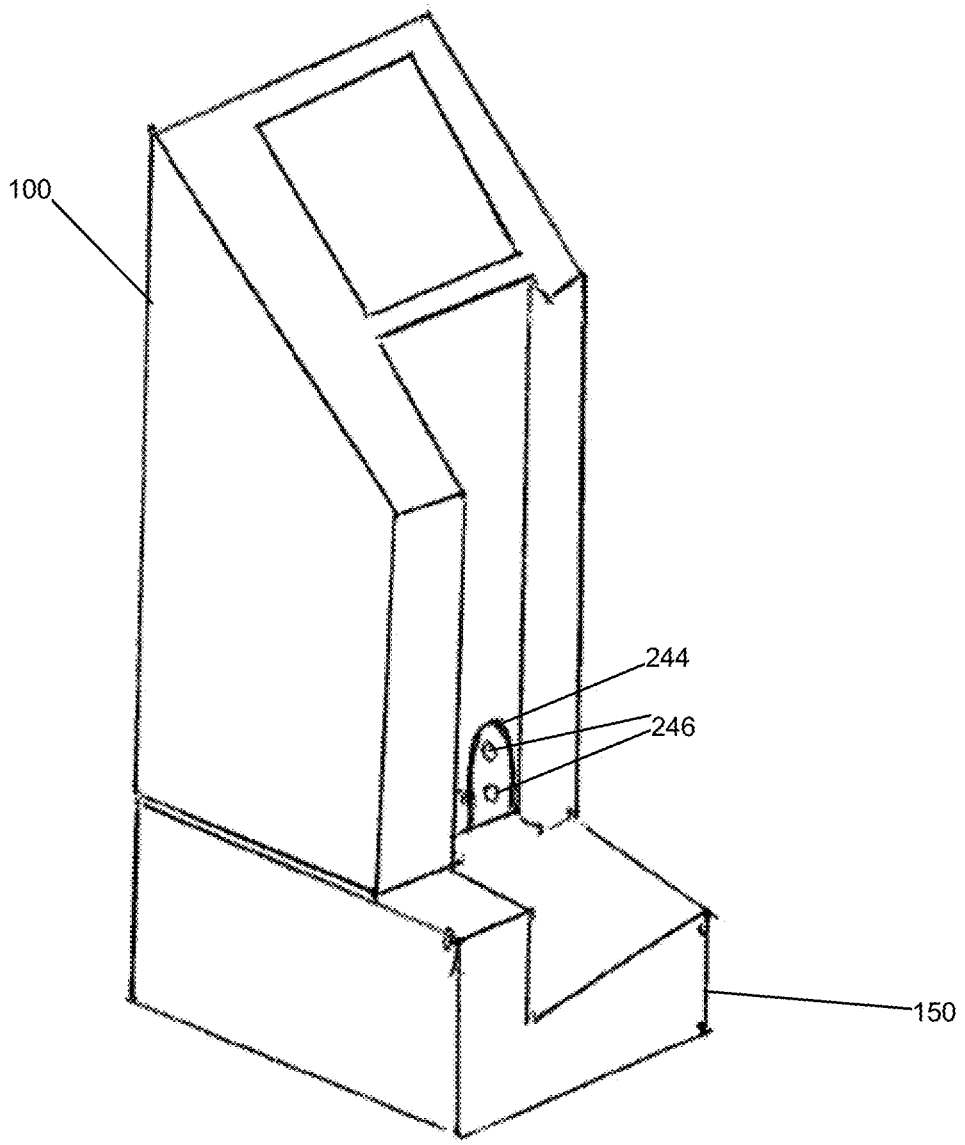
FIG. 12 is a perspective view of the frame assembly of FIG. 1.

With the first frame member 100, the second frame member 150, the first counterpart 210 (which may be connected to the reinforcement extension 250), and the second counterpart 230 connected together, the frame assembly 10 is assembled, as depicted in FIG. 12.

The corner connector 200 of the frame assembly 10 disclosed herein provides a plurality of connector ports, which allows for more fasteners to be used to assemble the frame assembly 10, which increases the strength, rigidity, and stiffness of the corner of the frame assembly 10.

As depicted in FIG. 1, the connectors 260, 270, and 280 fasten the components of the frame assembly 10 in more than one direction, such as positive-X, negative-X, and positive-Y directions. In some embodiments, for example, the second counterpart 230 is configured to define connector ports to fasten the components of the frame assembly 10 in any combination of directions, such as six directions, for example, positive-X, negative-X, positive-Y, negative-Y, positive-Z, and negative-Z, or a direction having components of the six directions positive-X, negative-X, positive-Y, negative-Y, positive-Z, and negative-Z. By increasing the number of directions of fastening, the strength, rigidity, and stiffness of the corner of the frame assembly 10 may be increased.

By fastening the second frame member 150 to the corner connector 200, for example, to the second counterpart 230 of the corner connector 200, along more than one side of the second frame member 150, for example, two sides, such as the side 162 and side 164, or three sides, such as the side 162, the side 164, and the side 166, the strength, rigidity, and stiffness of the connection between the second frame member 150 and the corner connector 200 may be increased.

By fastening the first frame member 100 to the corner connector 200, for example, to the second counterpart 230 of the corner connector 200, along more than one side of the first frame member 100, for example, two sides, such as the side 106 and side 108, the strength, rigidity, and stiffness of the connection between the first frame member 100 and the corner connector 200 may be increased.

By fastening the first counterpart 210 and the second counterpart 230 of the corner connector 200 along more than one side of the first counterpart 210, for example, three sides, such as the side 222, side 224, and side 226, the strength, rigidity, and stiffness of the connection between the first counterpart 210 and the second counterpart 230 may be increased.

By using the corner connector, defined by the first counterpart 210 and the second counterpart 230, which provides multiple fastening points to connect the first frame member 100 and the second frame member 150, the use of additional exterior steel plate reinforcements to strengthen the connection between the first frame member 100 and the second frame member 150 may be reduced or eliminated.

In some embodiments, for example, the first counterpart 210 and the second counterpart 230 facilitate relative positioning of the members of the frame assembly 10 such that the connectors that are used to connect the members of the frame assembly 10 may be guided by the connector ports to connect the members of the frame assembly 10 together, which may increase the ease of assembly of the frame assembly 10. In this regard, the first counterpart 210 and the second counterpart 230 facilitate locating of the connectors for assembling the frame assembly 10.

In some embodiments, for example, when the members of the frame assembly 10 are connected together, the members of the frame assembly 10 are unitarily fastened together to define a unitary body. When the frame assembly 10 is assembled, the first frame member 100 and the second frame member 150 obscures at least a portion of the first counterpart 210 and the second counterpart 230 to increase the aesthetic quality of the frame assembly 10.

In some embodiments, for example, the first frame member 100, the second frame member 150, the first counterpart 210, and the second counterpart 230 may be a kit for a frame assembly 10 or be parts for installing a frame assembly 10.

In some embodiments, for example, the corner connector 200, as described herein, includes the first counterpart 210 and the second counterpart 230 that are coupled together to form the corner connector 200. In some embodiments, for example, the corner connector 200 is a body of unitary one-piece construction having the shape of the first counterpart 210 and the second counterpart 230 connected together.

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

What is claimed is:

1. A kit for a frame assembly, comprising:
a first frame member;
a second frame member;
a first counterpart of a corner connector; and
a second counterpart of the corner connector;
wherein:
the first counterpart and the second counterpart are co-operatively configurable for connecting to obtain the corner connector, wherein one of the first counterpart and the second counterpart defines:
a first port for receiving a first fastener to enable fastening with a first side of the other one of the first counterpart and the second counterpart;
a second port for receiving a second fastener to enable fastening with a second side of the other one of the first counterpart and the second counterpart;
a third port for receiving a third fastener to enable fastening with a third side of the other one of the first counterpart and the second counterpart;
and
the first counterpart, the second counterpart, the first frame member, and the second frame member are co-operatively configurable for assembly to define a frame assembly, wherein the frame assembly includes:
the first frame member;
the second frame member;
wherein:
the first frame member is coupled to the second frame member via the obtained corner connector;
the corner connector is connected to the first frame member along a first side of the first frame member and is also connected along a second side of the first frame member; and
the corner connector is connected to the second frame member along a first side of the second frame member and is also connected along a second side of the second frame member.

2. The kit of claim 1, wherein the first counterpart is connectable to the second counterpart along the first side of the first counterpart, along the second side of the first counterpart, and also along the third side of the first counterpart.

3. The kit of claim 2, wherein the first side of the first counterpart is transverse the third side of the first counterpart, and the second side of the first counterpart is transverse the third side of the first counterpart.

4. The kit of claim 3, wherein the first side of the first counterpart is perpendicular to the third side of the first counterpart, and the second side of the first counterpart is perpendicular the third side of the first counterpart.

5. The kit of claim 2, wherein first side of the first counterpart is opposite the second side of the first counterpart.

6. The kit of claim 1, wherein the first side is transverse the third side, and the second side is transverse the third side.

7. The kit of claim 6, wherein the first side is perpendicular to the third side, and the second side is perpendicular to the third side.

8. The kit of claim 1, wherein the second side is opposite the first side.

9. The kit of claim 1, wherein the first side of the first frame member is transverse the second side of the first frame member.

10. The kit of claim 9, wherein the first side of the first frame member is perpendicular to the second side of the first frame member.

11. The kit of claim 1, wherein the first side of the first frame member is opposite the second side of the first frame member.

12. The kit of claim 1, wherein the first side of the second frame member is transverse the second side of the second frame member.

13. The kit of claim 12, wherein the first side of the second frame member is perpendicular to the second side of the second frame member.

14. The kit of claim 1, wherein the first side of the second frame member is opposite the second side of the second frame member.

15. A corner connector kit comprising:

a first counterpart and a second counterpart connectable to obtain a corner connector, wherein one of the first counterpart and the second counterpart defines:

a first port for receiving a first fastener to enable fastening with a first side of the other one of the first counterpart and the second counterpart;

a second port for receiving a second fastener to enable fastening with a second side of the other one of the first counterpart and the second counterpart;

a third port for receiving a third fastener to enable fastening with a third side of the other one of the first counterpart and the second counterpart;

the first counterpart and the second counterpart are cooperatively configurable with a first frame member and a second frame member to define a frame assembly;

wherein:

the first frame member is coupled to the second frame member via the obtained corner connector;

the corner connector is connected to the first frame member along a first side of the first frame member and is also connected along a second side of the first frame member; and the corner connector is connected to the second frame member along a first side of the second frame member and is also connected along a second side of the second frame member.

16. The kit of claim 15, wherein the first counterpart is connectable to the second counterpart along the first side of the first counterpart, along the second side of the first counterpart, and also along the third side of the first counterpart.

17. The kit of claim 16, wherein the first side of the first counterpart is transverse the third side of the first counterpart, and the second side of the first counterpart is transverse the third side of the first counterpart.

18. The kit of claim 17, wherein the first side of the first counterpart is perpendicular to the third side of the first counterpart, and the second side of the first counterpart is perpendicular to the third side of the first counterpart.

19. The kit of claim 16, wherein first side of the first counterpart is opposite the second side of the first counterpart.

20. The kit of claim 15, wherein the first side is transverse the third side, and the second side is transverse the third side.

21. The kit of claim 20, wherein the first side is perpendicular to the third side, and the second side is perpendicular to the third side.

22. The kit of claim 15, wherein the second side is opposite the first side.

23. The kit of claim 15, wherein the first side of the first frame member is transverse the second side of the first frame member.

24. The kit of claim 23, wherein the first side of the first frame member is perpendicular to the second side of the first frame member.

25. The kit of claim 15, wherein the first side of the first frame member is opposite the second side of the first frame member.

26. The kit of claim 15, wherein the first side of the second frame member is transverse the second side of the second frame member.

27. The kit of claim 26, wherein the first side of the second frame member is perpendicular to the second side of the second frame member.

28. The kit of claim 15, wherein the first side of the second frame member is opposite the second side of the second frame member.

* * * * *